US007937974B2

(12) United States Patent
Kim et al.

(10) Patent No.: US 7,937,974 B2
(45) Date of Patent: May 10, 2011

(54) DRUM DOOR LOCKING DEVICE FOR LAUNDRY APPARATUS

(75) Inventors: Jin Woong Kim, Seoul (KR); Na Eun Kim, Seoul (KR); Jae Won Chang, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 672 days.

(21) Appl. No.: 11/693,433

(22) Filed: Mar. 29, 2007

(65) Prior Publication Data

US 2007/0227199 A1 Oct. 4, 2007

(30) Foreign Application Priority Data

Mar. 29, 2006 (KR) ..... 10-2006-0028356

(51) Int. Cl.

| | |
|---|---|
| ***D06F 21/00*** | (2006.01) |
| ***D06F 23/00*** | (2006.01) |
| ***D06F 25/00*** | (2006.01) |
| ***F26B 11/02*** | (2006.01) |

(52) U.S. Cl. ..... 68/142; 68/139; 34/602

(58) Field of Classification Search ..... 68/139, 68/142; 34/602

See application file for complete search history.

(56) References Cited

U.S. PATENT DOCUMENTS

| | | | | |
|---|---|---|---|---|
| 7,073,356 | B2 * | 7/2006 | Nakamura et al. | 68/12.26 |
| 2004/0129035 | A1 * | 7/2004 | Chang | 68/23 R |

FOREIGN PATENT DOCUMENTS

| | | | |
|---|---|---|---|
| DE | 198 06 884 | | 8/1999 |
| DE | 19806884 | A1 * | 8/1999 |
| EP | 0943720 | A1 | 9/1999 |
| EP | 1 433 891 | | 6/2004 |
| EP | 1433891 | A2 * | 6/2004 |
| JP | 01-230390 | | 9/1989 |
| JP | 01230390 | A * | 9/1989 |
| JP | 01-317488 | | 12/1989 |

OTHER PUBLICATIONS

JP 01-230930 English Translation.*

JP 01-230930 English Translation Sep. 1989 Osada et al.*

European Search Report dated Feb. 23, 2009 for Application No. 07006403.5, 6 pages.

Korean Office Action dated Jan. 29, 2007, on Korean Application No. 10-2006-0028356, (3 pages).

Chinese Office Action dated Feb. 5, 2010 for Application No. 2007100809062.4, with English translation, 8 pages.

* cited by examiner

*Primary Examiner* — Michael Barr
*Assistant Examiner* — Charles W Kling
(74) *Attorney, Agent, or Firm* — Fish & Richardson P.C.

(57) ABSTRACT

A laundry processing apparatus is disclosed. The laundry processing apparatus includes a drum having a drum opening perforated in a circumferential surface thereof for entrance/exit of laundry, a drum door for opening and closing the drum opening, and a locking device for automatically coupling the drum and the drum door to each other while the drum and the drum door are rotated.

12 Claims, 3 Drawing Sheets

DRUM DOOR LOCKING DEVICE FOR LAUNDRY APPARATUS

This disclosure claims the benefit of the Korean Patent Application No. 10-2006-0028356, filed on Mar. 29, 2006, which is hereby incorporated by reference in its entirety.

BACKGROUND

1. Field

The disclosure relates to a laundry processing.

2. Discussion of Related Art

Generally, washing machines perform washing, rinsing, and dehydrating processes, in order to remove contaminants clinging to laundry by use of interaction of detergent and water. Such washing machines are classified, on the basis of their washing method, into a drum type washing machine, an agitator type washing machine, and a pulsator type washing machine.

An agitator type washing machine is adapted to wash laundry by rotating a blade-shaped agitator, which rises from the center of a washing tub, in opposite directions. A pulsator type washing machine is adapted to wash laundry by use of water streams created by rotating a disk-shaped pulsator.

In a drum type washing machine, water, detergent, and laundry are put into a drum formed with a plurality of protruding members, and the drum is rotated at a low speed about a horizontal axis such that the laundry is raised by the protruding members and falls down by their weight. Thereby, the drum type washing machine is able to wash the laundry by use of the falling shock of the laundry as well as the frictional force between respective articles of the laundry.

The drum type washing machine is further classified, on the basis of a laundry input manner, for instance, into a front loading type washing machine and a top loading type washing machine.

Generally, in a top loading type washing machine, an opening for the entrance and exit of laundry is made in a circumferential surface of the drum. Correspondingly, and to enable access to the interior of the drum, a drum door is positioned along the circumferential surface of the drum.

SUMMARY

Implementations may include one or more of the following features. In one example, a laundry processing apparatus includes a drum, a drum door, and a locking device. A circumferential surface of the drum defines a drum opening that accommodates entrance and exit of laundry into an interior of the drum. The drum door is configured and positioned to enable or prevent access to the interior of the drum through the drum opening. In one implementation, the locking device is configured to move relative to the drum and the drum door when the drum is fixed relative to the drum door, and to automatically couple the drum and the drum door to each other while the drum and the drum door are rotated. In this or another implementation, the locking device is configured to selectively couple or release the drum and the drum door to or from each other on the basis of a rotating velocity of the drum and the drum door. In these or yet other implementations, the locking device is configured to move relative to the drum and the drum door when the drum is fixed relative to the drum door, and to couple the drum and the drum door to each other while the drum and the drum door are rotated. As such, the drum and the drum door, which are coupled to each other, together support a tensile force generated during the rotation of the drum and the drum door in a circumferential direction of the drum.

DETAILED DESCRIPTION

In a top loading laundry apparatus, a door is configured to enable access to the laundry apparatus interior through a circumferential surface of the laundry apparatus' drum. A drum locking mechanism at an interior surface of the drum is configured to engage with a door locking mechanism at an interior surface of the door. The drum locking mechanism, the door locking mechanism, or both may be moved to enable a secured engagement between the two. For instance, in implementations illustrated by FIGS. 2-4, a hook-shaped door locking mechanism is moved into engagement with a stationary hook-shaped drum locking mechanism, a hook-shaped drum locking mechanism is moved into engagement with a door surface perforation, and pin-type drum locking mechanism is moved into engagement with a door surface perforation. In these and other contemplated configurations, movement by one or more of the locking mechanisms into an engaged or locked position may be inspired or assisted by an outward force caused by rotation of the drum.

Figure 1:
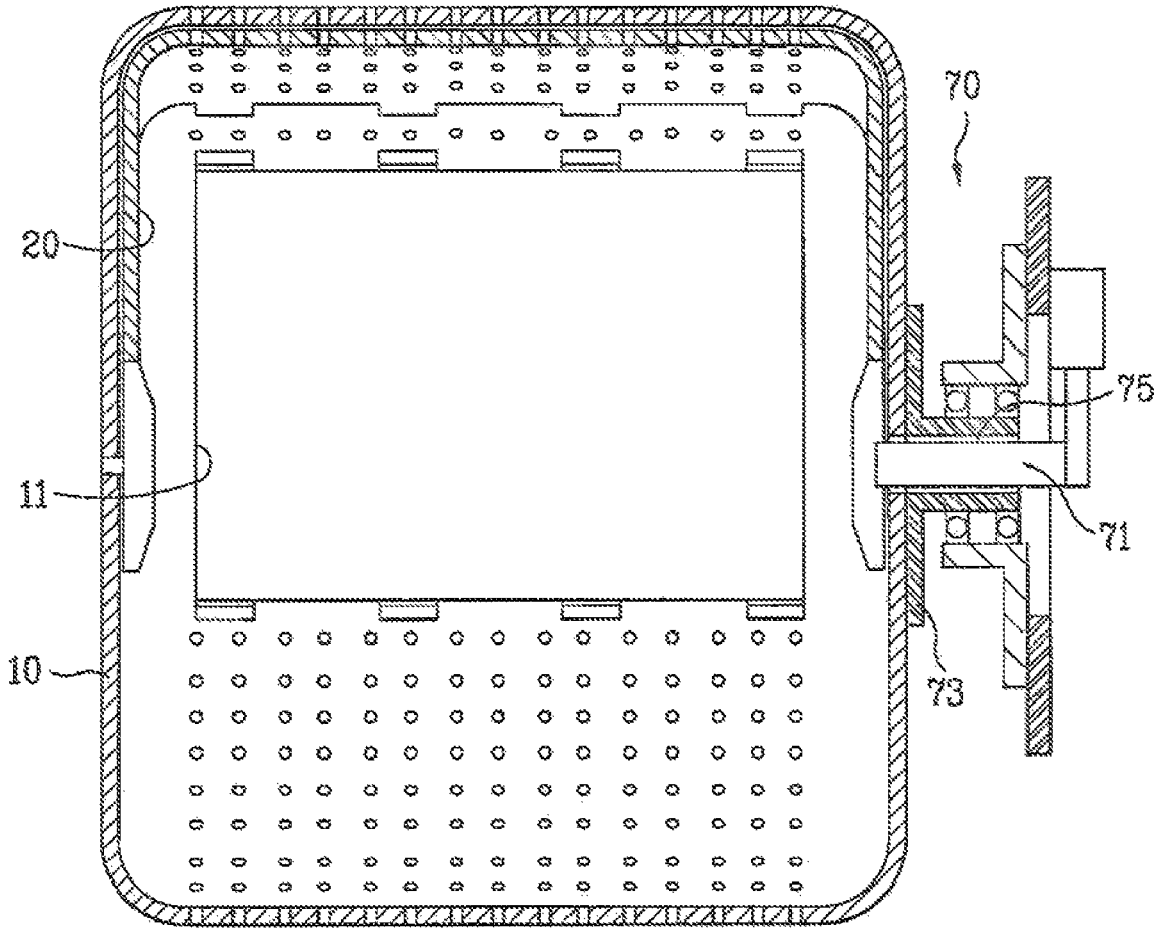
FIG. 1 is a sectional view schematically illustrating an aspect of a laundry processing apparatus.
Figure 2:
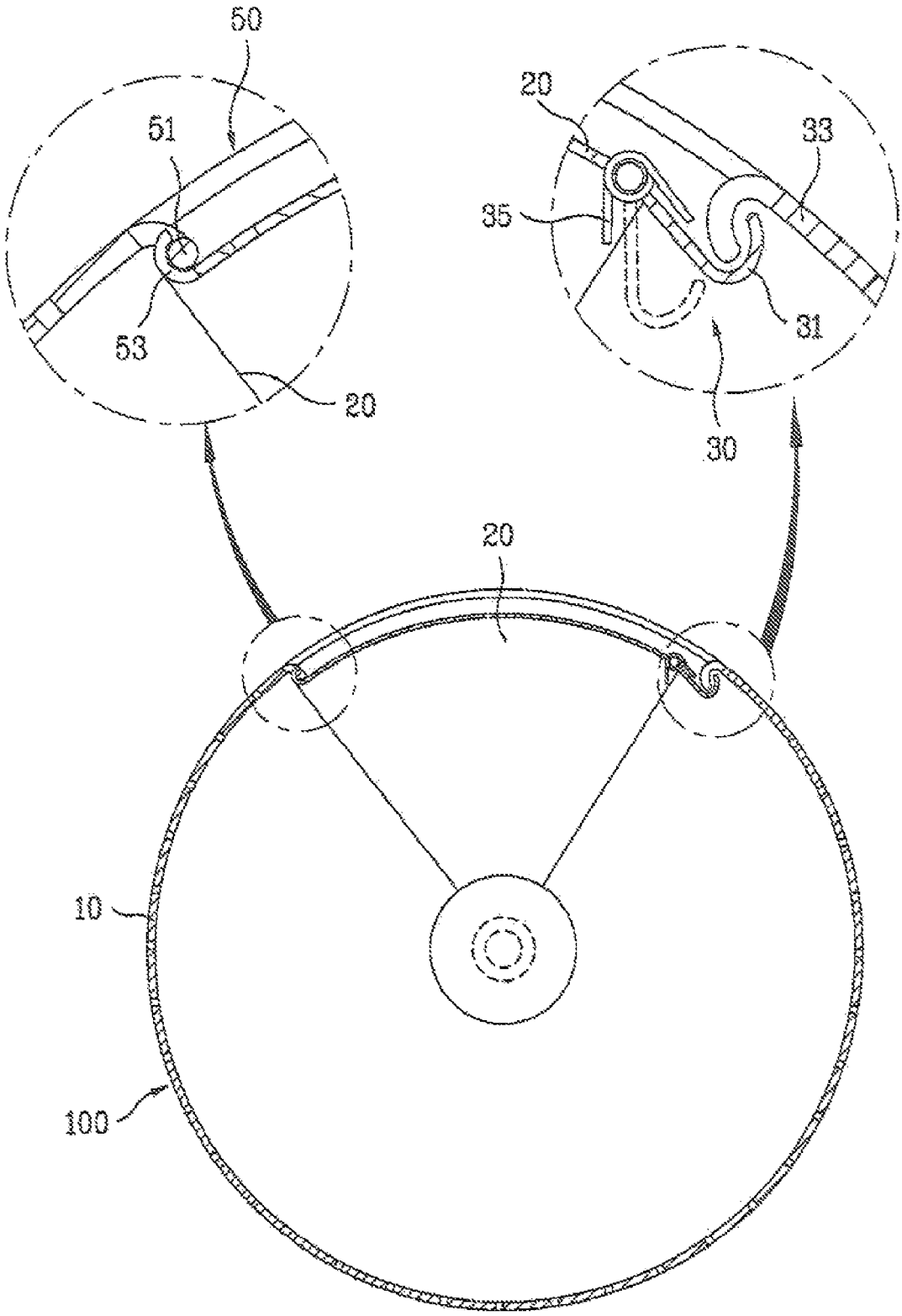
FIG. 2 is a view illustrating one implementation of a locking device provided in the laundry processing apparatus of FIG. 1.

With reference to FIGS. 1 and 2, an implementation of a laundry processing apparatus includes a washing apparatus for washing laundry, a drying apparatus for drying washed laundry, etc. The laundry processing apparatus includes a drum 10 formed with a drum opening 11 for entrance/exit of laundry, a drum door 20 for opening and closing the drum opening 11, and a locking device 30 for automatically coupling the drum 10 and the drum door 20 to each other while the drum 10 and the drum door 20 are rotated.

The laundry processing apparatus also includes a cabinet (not shown) forming the outer structure and defining an outer appearance of the laundry processing apparatus, a drive device 70 for operating the drum 10 and the drum door 20, and a measuring sensor (not shown) for sensing the position of the drum opening 11. In addition, the cabinet has a cabinet opening corresponding to the opening 11 of the drum 10.

The drum opening 11 is perforated in a circumferential surface of the drum 10. If the drum opening 11 is positioned to correspond to the cabinet opening, the drum door 20 is able to open the drum opening 11.

Specifically, before the drum door 20 opens the drum opening 11, the measuring sensor grasps the position of the drum opening 11 and the position of the cabinet opening. If the drum opening 11 reaches a position corresponding to the position of the cabinet opening, the measuring sensor sends a control signal for operating the drum door 20 to a controller.

In response to the control signal, the controller controls the drive device 70, to operate only the drum door 20 for opening or closing the drum opening 11. The drum door 20 is rotatable provided inside drum 10. The drum door 20 is adapted to open or close the drum opening 11 while sliding under the drum opening 11.

The drive device 70 includes a door rotating shaft 71 for rotating the drum door 20, a drum rotating shaft 73 for rotating the drum 10, and a clutch 75 for simultaneously or individually rotating the drum rotating shaft 73 and the door rotating shaft 71.

Here, when both the drum 10 and the drum door 20 are rotated, the clutch 75 engages the door rotating shaft 71 and the drum rotating shaft 73 to each other. Conversely, only when the drum door 20 is rotated, the clutch 75 disengages the door rotating shaft 71 and the drum rotating shaft 73 from each other.

Accordingly, both the drum 10 and the drum door 20 are rotated while the washing and dehydrating processes are performed, whereas only any one of the drum 10 and the drum door 20 is rotated when the drum door 20 opens the drum opening 11.

Meanwhile, a connecting device 50 is provided at a connecting region between the drum 10 and the drum door 20. The connecting device 50 serves to restrict rotating movement of the drum door 20 and to guarantee stable connection of the drum door 20 and the drum 10 when the drum door 20 closes the drum opening 11.

The connecting device 50 includes a protruding member 51 protruding from a rim portion of the drum opening 11 to an inner surface of the drum 10, and a connecting hook 53 provided at a distal end of one side of the drum door 20 and configured to correspond to the protruding member 51. The connecting device 50 serves to connect the drum 10 and the drum door 20 to each other at a distal end of one side of the drum opening 11.

Meanwhile, a locking device 30 is provided at a distal end of the other side of the drum opening 11 opposite to the connecting device 50 and adapted to automatically couple or release the drum door 20 and the drum 10. The locking device 30 accomplishes the coupling of the drum door 20 and the drum 10 by a centrifugal force generated by a mass of the locking device 30 while the drum 10 and the drum door 20 are rotated.

The locking device 30 includes a mass member configured to be moved by a centrifugal force generated by a mass thereof, and a coupling portion configured to correspond to the mass member and adapted to couple the drum 10 and the drum door 20 to each other.

In the present implementation, the mass member may include a door latch 31 hinged to a position of the drum door 20, and the coupling portion may include a door hook 33 provided at a position of the drum 10 and configured to be coupled with the door latch 31.

Moreover, the door latch 31 may be provided at a position of the drum 10, and the door hook 33 may be provided at a position of the drum door 20.

The locking device 30 further includes an elastic member for providing an elastic restoration force against movement of the mass member. The elastic member may be a torsion spring 35 coupled to a rotating shaft of the door latch 31.

Here, the magnitude of the centrifugal force, acting on the mass member while the drum 10 and the drum door 20 are rotated, is determined by the mass of the mass member, an angular velocity of rotation of the drum 10, and a radius of rotation of the drum 10.

The mass of the mass member and the radius of rotation of the drum 10 are previously determined upon the fabrication of the laundry processing apparatus. Therefore, the centrifugal force is determined by the angular velocity of rotation of the drum 10.

More specifically, if the angular velocity of rotation of the drum 10 and the drum door 20 is more than a specific angular velocity of rotation (hereinafter, referred to as "predetermined angular velocity"), the locking device 30 couples the drum 10 and the drum door 20 to each other. Also, if the angular velocity of rotation of the drum 10 and the drum door 20 is smaller than the predetermined angular velocity, the locking device 30 releases the coupling of the drum 10 and the drum door 20.

Accordingly, if the drum 10 and the drum door 20 reach the predetermined angular velocity, one side of the drum door 20 is coupled to the drum 10 by the connecting device 50, and the other side of the drum door 20 is coupled to the drum 10 by the locking device 30. Thereby, both the drum 10 and the drum door 20 make a single connected structure.

When the drum 10 and the drum door 20 make the single connected structure, laundry received in the drum 20 acquires a centrifugal force while being rotated about the drum rotating shaft 73. In this case, the centrifugal force of the laundry acts as a tensile force for stretching the drum 10 receiving the laundry in a circumferential direction of the drum 10. The drum 10 and the drum door 20, which are coupled to each other, can together support the tensile force generated during rotation of the drum 10 in the circumferential direction of the drum 10.

In one implementation, the following processes uses the locking device 30 to couple the drum 10 and the drum door 20 to each other during rotation of the drum 10 and the drum door 20.

First, if the drum door 20 closes the drum opening 11, the protruding member 51 and the connecting hook 53 keep their engaged state. In this case, the door latch 31 is drooped by a load thereof, and no force acts on the torsion spring 35.

Then, if the drum 10 and the drum door 20 are rotated, the door latch 31 acquires a centrifugal force by the rotation of the drum door 20. Here, if the angular velocity of rotation of the drum 10 an the drum door 20 is more than the predetermined angular velocity, the door latch 31 is coupled with the door hook 33 by the centrifugal force thereof.

In this case, the torsion spring 35 has an elastic restoration force against movement of the door latch 31. Consequently, when the drum 10 and the drum door 20 are rotated above the predetermined angular velocity, the centrifugal force, acting on the door latch 31, has to have a larger value than a total value of the load of the door latch 31 and the elastic restoration force of the torsion spring 35, for guaranteeing the automatic coupling of the door latch 31 and the door hook 33.

Thereafter, if the angular velocity of rotation of the drum 10 and the drum door 20 is less than the predetermined angular velocity, the coupling of the door latch 31 and the door hook 33 is automatically released.

Figure 3:
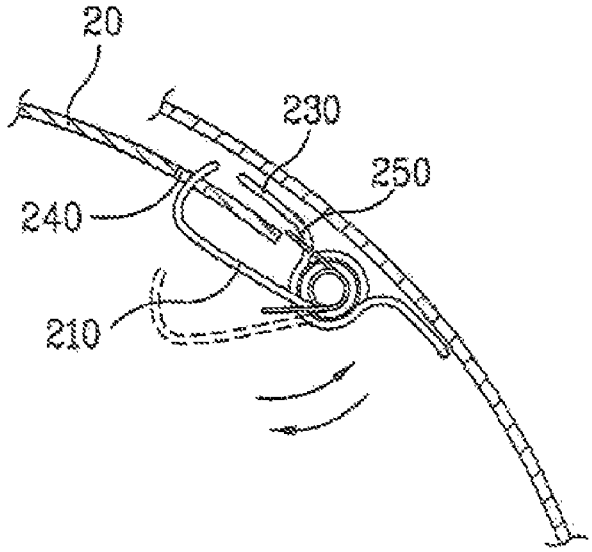
FIG. 3 is a view illustrating another implementation of a locking device provided in the laundry processing apparatus of FIG. 1.

With reference to another implementation shown by FIG. 3, the locking device includes the mass member configured to be moved by a centrifugal force generated by the mass thereof, and the coupling portion configured to correspond to the mass member and adapted to couple the drum 10 and the drum door 20 to each other.

However, the FIG. 3 mass member may include a hanger member 210 provided at a position of the drum 10, and the coupling portion may include a through-hole 240 provided at a position of the drum door 20 and configured to correspond to the hanger member 210.

The FIG. 3 locking device further includes a fixing member 230 for fixing one end of the hanger member 210 to the inner surface of the drum 10, and an elastic member 250 for providing an elastic restoration force against movement of the hanger member 210. The elastic member 250 may be a torsion spring installed to a rotating shaft of the hanger member 210.

In one implementation, the following process uses the locking device 30 to couple and release the drum 10 and the drum door 20 to or from each other.

If the drum 10 and the drum door 20 are rotated, the hanger member 210 begins to be affected by a centrifugal force generated by a load thereof. Then, if the angular velocity of rotation of the drum 10 and the drum door 20 is more than the predetermined angular velocity, the other end of the hanger member 210 penetrates the through-hole 240.

In this case, the elastic member 250 has an elastic restoration force against rotating movement of the hanger member 210. Consequently, the centrifugal force, acting on the hanger member 210 by the predetermined angular velocity, has to have a larger value than a total value of the load of the hanger member 210 and the elastic restoration force of the torsion spring 250, for guaranteeing the automatic coupling of the hanger member 210 into the through-hole 240.

Thereafter, if the angular velocity of rotation of the drum 10 and the drum door 20 is less than the predetermined angular velocity, the coupling of the hanger member 210 and the through-hole 240 is automatically released.

Figure 4:
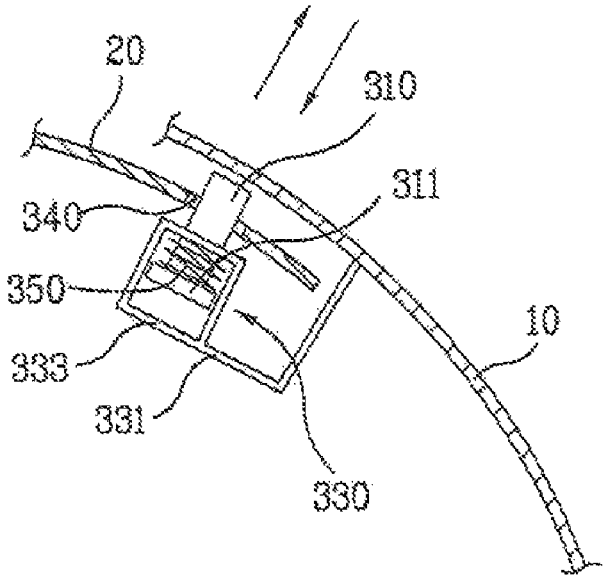
FIG. 4 is a view illustrating yet another implementation of a locking device provided in the laundry processing apparatus of FIG. 1.

With reference to the implementation illustrated by FIG. 4, the locking device includes the mass member configured to be moved by a centrifugal force generated by the mass thereof, and the coupling portion configured to correspond to the mass member and adapted to couple the drum 10 and the drum door 20 to each other.

The mass member may include a movable member 310 adapted to move in a radial direction of the drum 10, and the coupling portion may include a through-hole 340 perforated in a position of the drum door 20 and configured to correspond to the movable member 310.

The locking device may further include a fixing and guiding member 330 for guiding movement of the movable member 310, and simultaneously providing a space for receiving the movable member 310.

The fixing and guiding member 330 includes a supporting portion 331 coupled to the drum 10, and a movable member receiving portion 333 extended from the supporting portion 331 and configured to receive the movable member 310 therein. The movable member receiving portion 333 is formed with a guide hole (not shown) for the entrance and exit of the movable member 310.

An elastic member 350 is installed in the movable member receiving portion 333 and adapted to provide the movable member 310 with an elastic restoration force against movement of the movable member 310. The elastic member 350 may include a coil spring installed to surround a part of an outer periphery of the movable member 310.

Specifically, one end of the coil spring is supported by a wall surface of the movable member receiving portion 333, and the other end of the coil spring is supported by a head 311 of the movable member 310.

Accordingly, if the drum 10 and the drum door 20 are rotated beyond the predetermined angular velocity, the movable member 310 is moved in a radial direction of the drum 10 by a centrifugal force generated by a load thereof, and finally penetrates the through-hole 340 by passing through the guide hole perforated in the movable member receiving portion 333.

Similarly, the centrifugal force, acting on the movable member 310 by the predetermined angular velocity, has to have a larger value than a total value of the load of the movable member 310 and the elastic restoration force of the elastic member 350, for guaranteeing the automatic coupling of the movable member 310 into the through-hole 340.

In one or more of the above-described implementations, unintentional opening of the drum door 20 is prevented by the installation and operation of a locking device for automatically coupling a drum door 20 and a drum to each other by use of a centrifugal force generated by the mass of the locking device while the drum and the drum door are rotated.

Furthermore, in at least one implementation, the locking device allows the drum and the drum door to make a single connected structure while the drum and the drum door are rotated at a high sped. As such, a tensile force that acts in a circumferential direction of the drum by a centrifugal force of laundry may be efficiently supported.

Still further, in at least one implementation, the drum and the drum door can be selectively coupled to or released from each other on the basis of an angular velocity of rotation of the drum and the drum door. Accordingly, the drum and the drum door can be safely coupled to or released from each other without additional equipment.

As a result, some implementations may reduce manufacturing costs and increase the reliability of products.

What is claimed is:

1. A laundry processing apparatus comprising:

a drum, a circumferential surface of the drum defining a drum opening that accommodates entrance and exit of laundry into an interior of the drum;

a drum door configured and positioned to enable or prevent access to the interior of the drum through the drum opening while sliding under the drum opening; and a locking device, configured to move relative to the drum and the drum door when the drum is fixed relative to the drum door, to automatically couple the drum and the drum door to each other while the drum and the drum door are rotated, wherein the locking device comprises:

a hanger member installed at an inner wall of the drum and rotatable by a centrifugal force generated by the rotation of the drum so as to lock the drum door in a direction perpendicular to the movement direction of the drum door, and a coupling portion including a portion of the drum door configured to receive a portion of the hanger member.

2. The laundry processing apparatus according to claim 1, wherein the locking device further comprises an elastic member for providing an elastic restoration force that opposes movement of the hanger member otherwise resulting from the centrifugal force.

3. The laundry processing apparatus according to claim 1, wherein the locking device further comprises a fixing member for fixing one end of the hanger member to an inner surface of the drum.

4. The laundry processing apparatus according to claim 1, wherein the drum door is rotatably installed inside the drum.

5. A laundry processing apparatus according to claim 2 comprising:

a drum, a circumferential surface of the drum defining a drum opening that accommodates entrance and exit of laundry into an interior of the drum;

a drum door configured and positioned to enable or prevent access to the interior of the drum through the drum opening while sliding under the drum opening; and a locking device, configured to move relative to the drum and the drum door when the drum is fixed relative to the drum door, to automatically couple the drum and the drum door to each other while the drum and the drum door are rotated, wherein the locking device comprises:

a movable member installed at an inner wall of the drum and movable in a radial direction of the drum by a centrifugal force generated by the rotation of the drum so as to lock the drum door in a direction perpendicular to the movement direction of the drum, and a coupling portion that includes a portion of the drum door configured to receive a portion of the movable member.

6. The laundry processing apparatus according to claim 5, wherein the locking device further comprises a fixing and guiding member for guiding movement of the movable member and providing a space for receiving the movable member.

7. The laundry processing apparatus according to claim 6, wherein the fixing and guiding member comprises:

a supporting portion coupled to the drum; and a movable member receiving portion extended from the supporting portion and configured to receive the movable member therein.

8. A laundry processing apparatus comprising:

a drum having a drum opening defined by an opening in a circumferential surface of the drum and thus enabling entrance/exit of laundry;

a drum door rotatably installed inside the drum and configured to enable opening and closing of the drum opening while sliding under the drum opening; and a locking device configured to selectively couple or release the drum and the drum door to or from each other on the basis of a rotating velocity of the drum and the drum door, wherein the locking device is installed at an inner wall of the drum and moved by centrifugal force generated by the rotation of the drum so as to lock the drum door in a direction perpendicular to the movement direction of the drum door.

9. The laundry processing apparatus according to claim 8, wherein the locking device comprises:

a mass member configured to be moved by a centrifugal force generated by a mass thereof; and a coupling portion configured to correspond to the mass member and adapted to couple the drum and the drum door to each other.

10. The laundry processing apparatus according to claim 9, wherein the rotating velocity of the drum and the drum door, as a criterion of the coupling and release of the drum and the drum door, is determined by a radius of rotation of the drum and the mass of the mass member.

11. The laundry processing apparatus according to claim 9, wherein the locking device further comprises an elastic member for providing an elastic restoration force that opposes movement of the mass member based on rotation thereof.

12. The laundry processing apparatus according to claim 11, wherein the rotating velocity of the drum and the drum door, as a criterion of the coupling and release of the drum and the drum door, is determined by a radius of rotation of the drum, the mass of the mass member, and the elastic restoration force of the elastic member.

* * * * *